United States Patent [19]

Rundo

[11] Patent Number: 4,873,803

[45] Date of Patent: Oct. 17, 1989

[54] INSULATING A WINDOW PANE

[75] Inventor: John R. Rundo, Strongsville, Ohio

[73] Assignee: The B.F. Goodrich Company, Akron, Ohio

[21] Appl. No.: 206,075

[22] Filed: Jun. 13, 1988

[51] Int. Cl.[4] ..... E06B 3/54

[52] U.S. Cl. ..... 52/202; 52/208; 52/397; 52/401; 52/775

[58] Field of Search ..... 52/202, 203, 208, 211, 52/217, 393, 400–402, 717.1, 766, 772, 775, 776, 397–403

[56] References Cited

U.S. PATENT DOCUMENTS

| | | | |
|---|---|---|---|
| 1,029,071 | 6/1912 | Le Page . | |
| 1,745,652 | 2/1930 | Watson . | |
| 2,454,975 | 11/1948 | Pelley . | |
| 2,595,927 | 5/1952 | Chapin . | |
| 2,781,561 | 2/1957 | Gifford et al. . | |
| 3,389,522 | 6/1968 | Hordis | 52/401 |
| 3,455,080 | 7/1969 | Meadows | 52/775 X |
| 3,468,516 | 11/1967 | Jounot . | |
| 3,824,753 | 7/1974 | Anderson . | |
| 3,964,225 | 6/1976 | Yoshida | 52/766 |
| 3,971,178 | 7/1976 | Mazzoni et al. . | |
| 4,055,923 | 11/1977 | Biebuyck . | |
| 4,121,394 | 10/1978 | Brooks . | |
| 4,139,971 | 2/1979 | Kimura . | |
| 4,147,006 | 4/1979 | Kruschwitz | 52/401 |
| 4,156,988 | 6/1979 | Grover et al. . | |
| 4,235,056 | 11/1980 | Griffin . | |
| 4,351,137 | 9/1982 | Enyart et al. . | |
| 4,431,691 | 2/1984 | Greenlee . | |
| 4,555,884 | 12/1985 | van Eerden | 52/397 |
| 4,561,223 | 12/1985 | Gold et al. . | |
| 4,566,233 | 1/1986 | Naka . | |
| 4,612,743 | 9/1986 | Salzer | 52/208 |
| 4,625,479 | 12/1986 | Giguere | 52/202 |
| 4,648,231 | 3/1987 | Laroche | 52/775 |
| 4,702,050 | 10/1987 | Giguere | 52/202 |
| 4,754,585 | 7/1988 | Rundo . | |

FOREIGN PATENT DOCUMENTS

| | | | |
|---|---|---|---|
| 38935 | 8/1973 | Australia . | |
| 637728 | 1/1964 | Belgium | 52/775 |
| 2263990 | 7/1973 | Fed. Rep. of Germany . | |
| 1052020 | 12/1966 | United Kingdom . | |
| 1189518 | 4/1970 | United Kingdom . | |

*Primary Examiner*—Richard E. Chilcot, Jr.
*Attorney, Agent, or Firm*—Joseph Januszkiewicz

[57] ABSTRACT

A window structure using a structural retainer support for converting a conventional window into a double insulated window. Sealant tape is applied to the inside periphery of the primary conventional window pane. A thin flat retainer is secured to the window adjacent to the sealant tape. The flat retainer has a flange that is integral with the retainer and extends from its midsection and lies parallel to the adjacent flat portion defining a channel therebetween. A second window pane lies in abutting contact with the flange of the retainer while also lying in abutting contact with the sealant strip which is tacky to provide a dead air space between the two window panes. A trim member is latched to the retainer by having a longitudinally extending strip means that latches into a latch means in the channel of the retainer. The trim member exerts pressure on the second window pane to firmly retain the pane against the sealant tape.

6 Claims, 4 Drawing Sheets

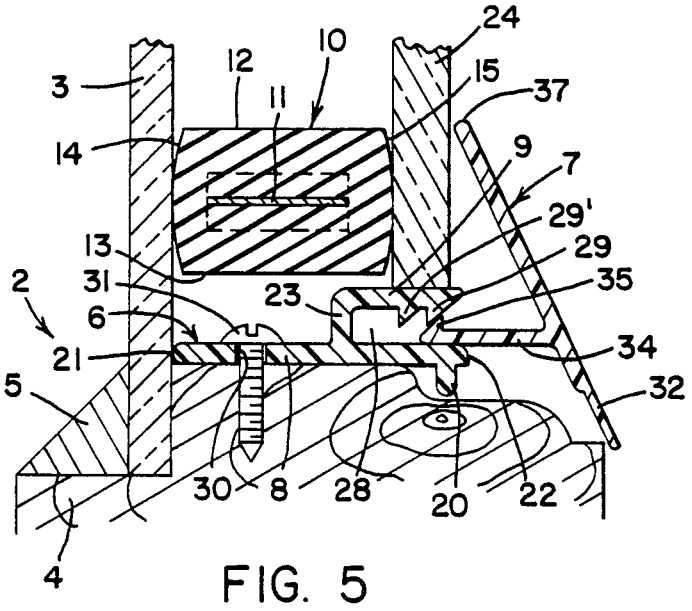
FIG. 5
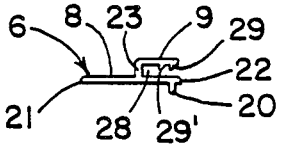
FIG. 11
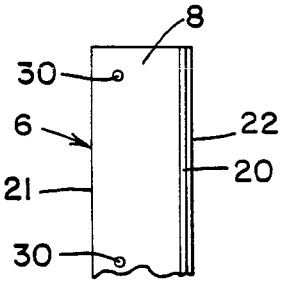
FIG. 9
FIG. 6
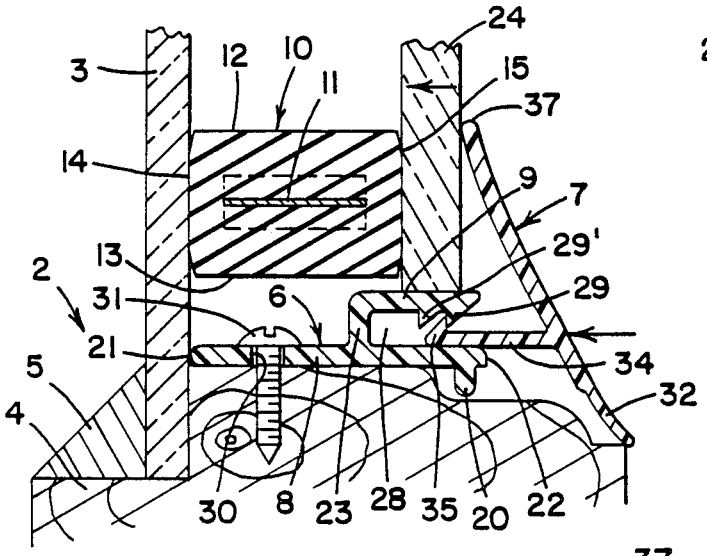
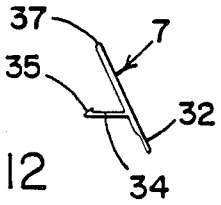
FIG. 12
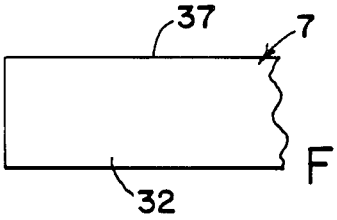
FIG. 10

INSULATING A WINDOW PANE

BACKGROUND OF THE INVENTION

The present invention relates to the retrofitting of a second pane of glass to the interior of an existing single pane window, providing a dead air space therebetween resulting in an effective insulating means.

With the cost of heating and cooling energy becoming more expensive it is important to provide effective and inexpensive means for insulating windows, including old residential and commercial buildings. The means heretofore used were essentially applicable to commercial retrofitting because of the initially high cost; however, with the present invention means have been provided for retrofitting residential windows in a very cost effective way. The present invention provides a compression means that applies an even pressure to the secondary window's entire periphery which in turn ensures a positive sealing of the dead air space between the two window panes. There is also provided a simple inexpensive way to provide adjustibility in the compressive force as well in simplifying the installation means to permit a non-experienced installer to effect an installation that is professional and aesthetic in appearance.

SUMMARY OF THE INVENTION

A structural retainer support means for use in providing a simple and inexpensive profile for securing a second window pane to a conventional residential window structure. A sealant tape is applied to the entire periphery of a primary conventional window pane. A thin flat retainer strip is applied between the sealant and the window frame while being secured to the window frame. The retainer has a flat flange that extends integrally from the midpoint of the retainer outwardly away from the primary window pane and cooperates with the retainer to form a channel. A second pane is placed into abutting contact with the tacky sealant strip while in contact with or resting on the flange. A flat trim member is latched to the retainer and applies pressure to the second pane to assure a dead air space between the two panes while yielding arcuately to provide an aesthetic appearance.

BRIEF DESCRIPTION OF THE DRAWINGS

FIG. 5 is an enlarged cross sectional view of the primary and secondary window panes and the retrofitting elements similar to FIG. 2, but with the trim member in a preliminary position for engaging a retainer member;

FIG. 6 is an enlarged cross sectional view similar to FIG. 5 but with the trim member partially engaging the retainer member holding the secondary pane in position to create a dead air space;

FIG. 9 is a bottom plan view of the retainer shown in actual size;

FIG. 10 is a front elevational view of the trim member shown in actual size;

FIG. 11 is side elevational view of the actual size of the retainer; and

FIG. 12 is a side elevational view of actual size of the trim member.

DETAILED DESCRIPTION

Figure 1:
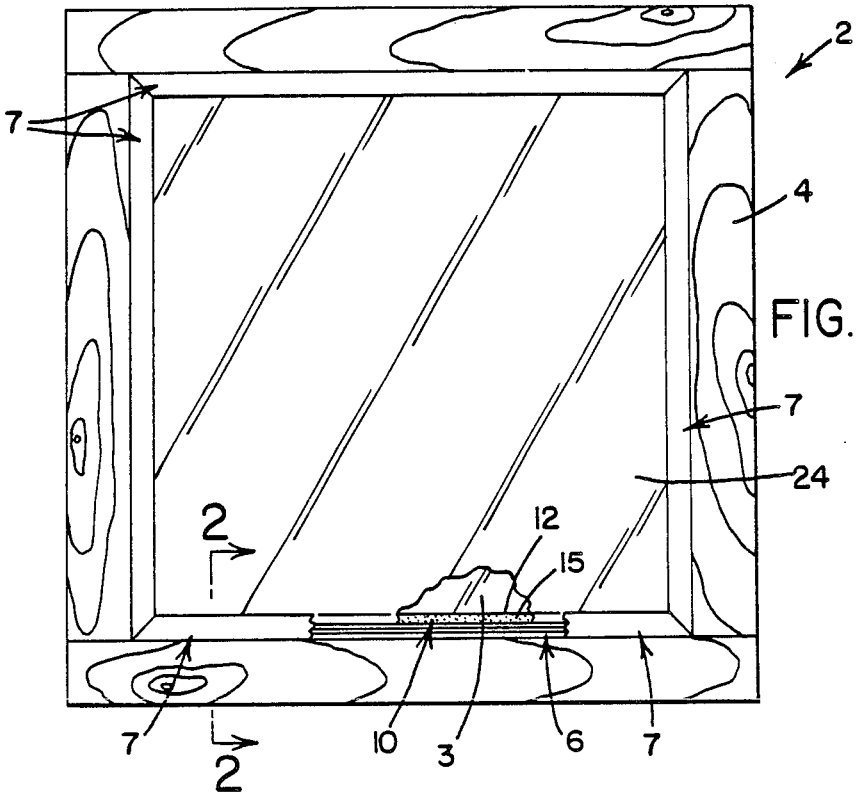
FIG. 1 is a front elevational view of a window pane, installation structure with a portion broken away to illustrate the components used in retrofitting a conventional window structure.

Referring now to the drawings, wherein like reference numerals designate like or corresponding parts throughout the several views, there is shown in FIG. 1 a conventional window structure 2 which includes a glass pane 3 mounted in a window frame or a permanent frame support 4 with the pane resting on the bottom portion of such frame of the window frame 4 and with a trim member or hardened glazing compound 5 on the periphery of the glass pane 3 to retain such pane 3 on the frame support 4. Such hardened glazing or trim 5 is on the exterior of the glass pane 3. The sash frame as used herein refers to the bottom support of a window frame or frame support 4. The window frame structure as seen in FIG. 1 is essentially square or rectangular in shape.

Figure 2:
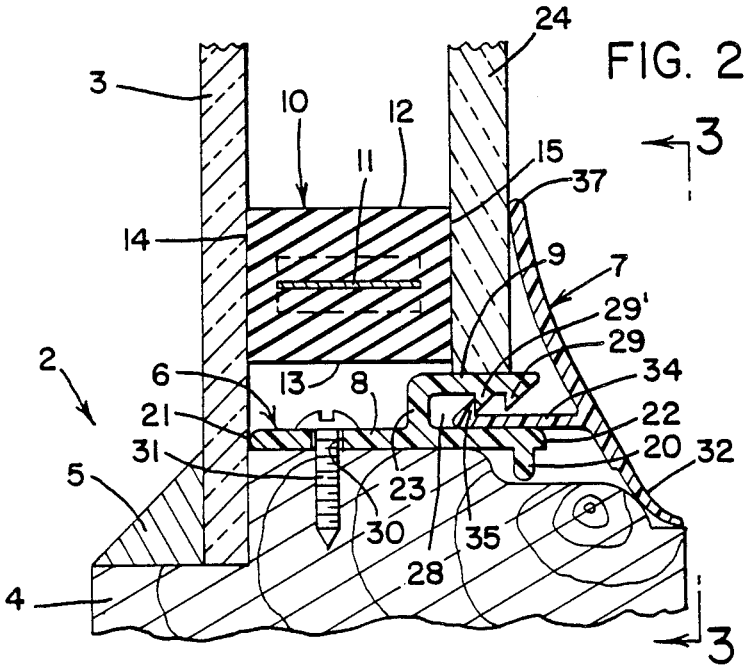
FIG. 2 is a sectional view on an enlarged scale of the primary and secondary window panes and the retrofitting elements, taken on line 2—2 of FIG. 1.
Figure 3:
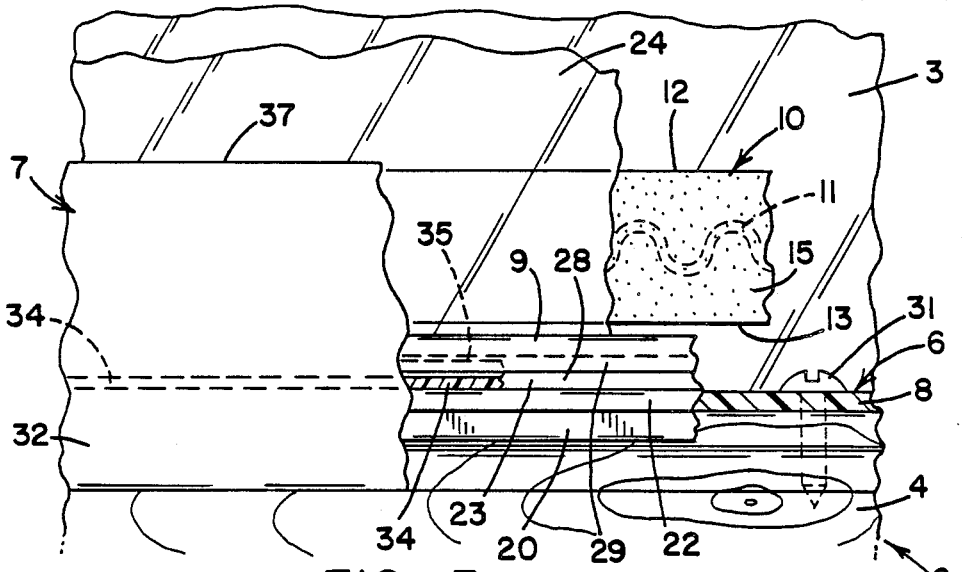
FIG. 3 is a fragmentary front elevational view taken on line 3—3 of FIG. 2 with portion of the retrofitting elements and secondary window pane broken away.
Figure 4:
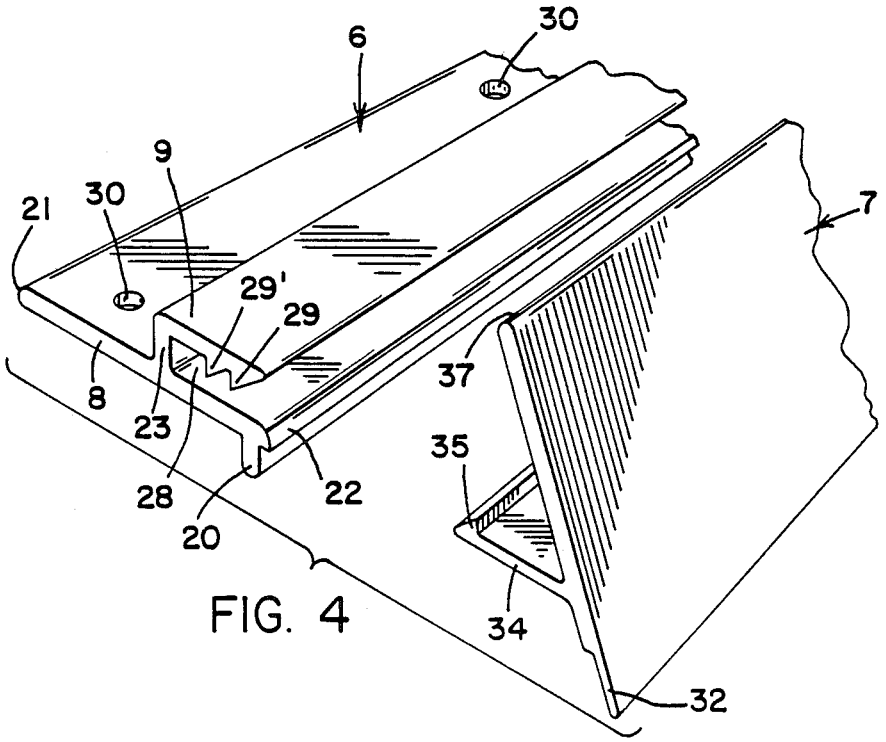
FIG. 4 is an enlarged, exploded perspective view of the retrofitting elements wherein the retainer element has the trim member separated therefrom.

Extending along the full peripheral length of the interior of the window frame 4 is a retainer 6 and a trim member 7. As seen in FIG. 1, retainer 6 and trim member 7 as applied to the window frame perimeter is composed of four lengths suitably mated at the respective corners. Only a portion of the retainer 6 and its cooperative trim member 7 will be described, which is shown in enlarged cross section in FIGS. 2–8. As shown in FIG. 2, the retainer 6 is secured to the window frame 4.

A sealant deformable strip or tape 10 consisting of a generally rectangular shaped (in cross section) envelopes a spacer means 11 which extends longitudinally of the strip 10. The spacer means 11 is in the form of an undulating strip of a sine curve configuration of rigid material which may be aluminum. The sealant strip 10 because of its geometry resists compression forces exerted on it in a plane that is normal to the longitudinally extending direction of the strip 10. It is to be noted that the strip 10 in its natural undeformed condition (FIG. 5) has two parallel sides 12 and 13 and two arcuate sides 14 and 15 (FIG. 5). The sealant strip would preferably include a desiccant which removes moisture from the air space that the sealant encloses. When sufficient pressure is applied to the sealant tape 10 by a window pane or glazing to be described, such arcuate sides 14 and 15 assume a linear shape (FIG. 2).

The retainer 6 is composed of two integral parts including a rigid longitudinally extending flat base 8 and a flange or flange member 9 that is integral therewith and parallel to the general flat direction in which the base 8 extends. The base 8 has a flat longitudinally extending portion with a depending rib 20 that extends for the full length thereof. Base 8 has a forwardly disposed edge 21 (exterior edge) and a rearwardly disposed edge 22 (interior edge). Such base 8 is relatively thin, apProximately 1.5 cm in width as illustrated in FIG. 10 and having a single thickness of approximately 1/10 of a centimeter. Approximately midway between the respective running edges 21 and 22 of base 8 and integrally formed therewith is an outwardly extending rib 23 that is connected to the longitudinally extending flange 9 that is parallel to the longitudinally extending base. Such flange 9 is parallel to the base and forms a channel or groove 28 in cooperation with the rearwardly disposed portion of such base 8 (which base portion includes the edge 22). Flange 9 has a pair of projecting abutments 29–29' which are saw tooth in shape projecting within the groove 28 for a purpose to be described. The base 8 of the retainer 6 has a plurality of bores 30 along its running length to receive screws 31 to secure such retainer 6 onto the window frame 4 such that the forwardly disposed edge or exterior edge 21 abuts window pane 3.

A second window pane or glazing 24 is then placed into abutting contact with the tacky sealant strip or tape 10 while resting on or abutting the flange 9.

Trim member 7 is a thin longitudinally extending rigid member having an upper portion and a lower portion 32 wherein the lower portion is approximately one half the thickness of the upper portion to providing a yielding or flexing of the lower portion in a manner to be described. Extending outwardly from the main body portion of the trim member 7 which is at the juncture of the upper portion and the lower portion 32 is a continuous flat rigid strip member or latch member 34. Such strip member 34 has an abutment 35 on its outermost portion in the shape of a saw tooth for latching or locking engagement with the abutments 29–29' in the narrow channel 28. It is to be noted that when the trim member 7 has its abutment 35 closely adjacent to the channel 28, the uppermost edge 37 (FIG. 5) of trim member 7 lies closely adjacent to the second pane or glazing 24 and that as the abutment 35 enters channel 28 and engages the first abutment 29 the trim member assumes a slight bow as edge 37 firmly engages the second pane 24 (Note FIG. 6). As additional pressure is applied to the trim member 7 along the full length of the strip member 34, the abutment 35 engages the second abutment 29' (FIG. 2) in which instance the trim member 7 assumes a greater bending since it applies sufficient pressure on the second pane 24 to firmly maintain such pane 24 in engagement with the sealant strip 10 along the full length of the pane. During this progressive stage where trim member's 7 abutment 35 seats further into the channel 28, the sealant strip 10 goes from a position where the sides 14 and 15 go from an arcuate shape as in FIG. 5 to slightly arcuate in FIG. 6, to a linear shape as in FIG. 2.

Figure 7:
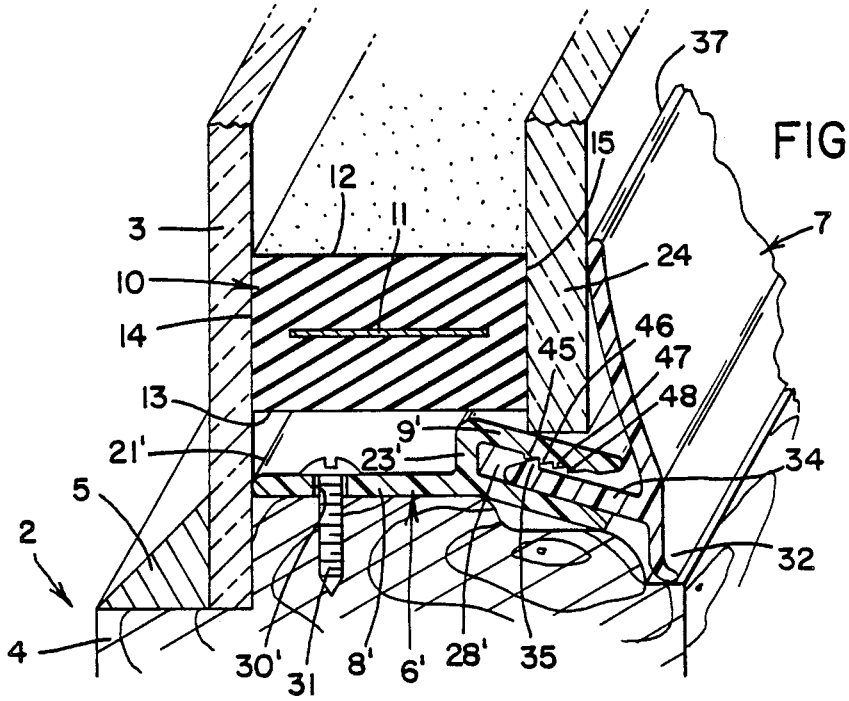
FIG. 7 is an enlarged perspective view partly in cross section of a modified form of the retrofitting elements installed including the engagement of the trim member with retainer.
Figure 8:
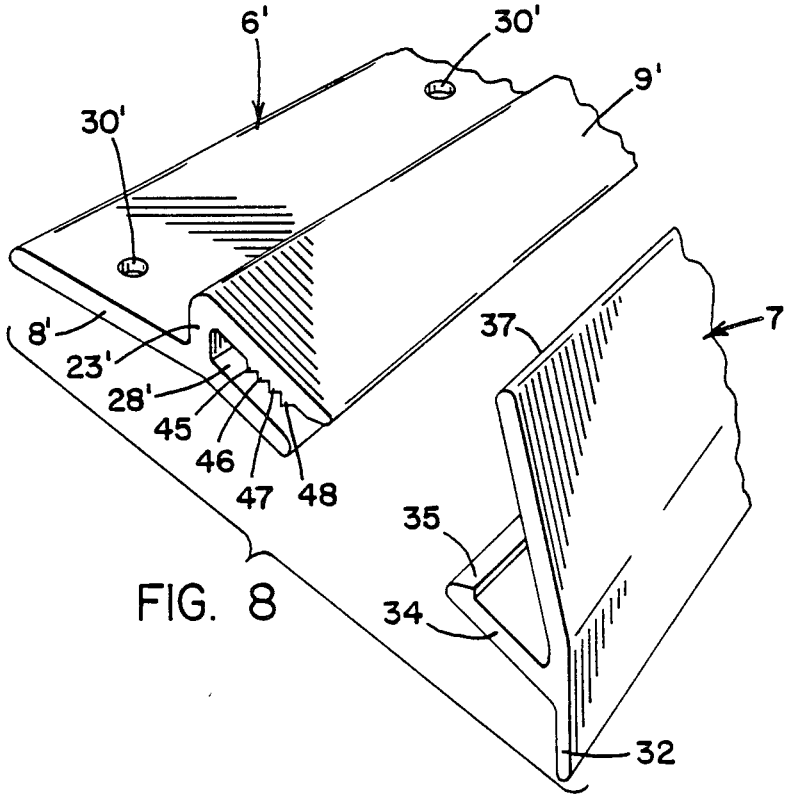
FIG. 8 is an enlarged exploded perspective view of the retrofitting elements of the modification of FIG. 7 showing retainer and the trim member.

A modification of the retainer 6 is shown in FIGS. 7 and 8 wherein the retainer is indicated as 6' and is substantially identical to that of retainer 6 just described except that flange 9' has four (4) abutments 45–46–47–48 projecting into the channel 28'. The trim member 7 is similar to the first described embodiment and accordingly the same numerals are used therein. The installation of the second embodiment is the same as that described in the first embodiment except that the greater number of projections or abutments in the second embodiment provide for a greater degree of adjustment of pressure on the pane 24.

It will be apparent that although a specific embodiment and a modification of the invention has been described in detail, the invention is not limited to the specifically illustrated and described constructions since variations may be made without departing from the principles of the invention.

I claim:

1. A double glazed window structure consisting of a rectangular window frame; a first pane seated in said window frame; said first pane having an exterior surface, an interior surface and a periphery; said window frame being recessed to abuttingly contact said interior surface along said periphery to receive said first pane to define a one piece unit; glazing means abutting the periphery of said exterior surface of said first pane and said window frame to securely fasten and retain said first pane in said window frame; a sealant tape mounted around and adhered to the peripheral interior surface of said first pane, a flat longitudinally extending rigid retainer support member mounted on said window frame closely adjacent said peripheral interior surface of said first panel; said retainer having a forwardly disposed edge and a rearwardly disposed edge; said forwardly disposed edge abutting said first pane; said retainer having a plurality of spaced holes closely adjacent to said forwardly disposed edge to receive securing means to fasten said retainer to said window frame; said retainer having a midportion located between said forwardly disposed edge and said rearwardly disposed edge; said retainer having a longitudinally extending flange member integrally connected to said midportion of said retainer; said flange member cooperative with that portion of said retainer adjacent to said rearwardly disposed edge to define a narrow channel therebetween; said flange portion disposed inside of said narrow channel has at least a pair of abutments; a second pane having the peripheral edge of one surface in abutting contact with said sealant tape; said second pane having its peripheral edge in sealing contact with said flange; a thin longitudinally extending flat rigid trim member having a running length with an upper portion and a lower portion; the juncture of said upper portion and said lower portion having an outwardly extending thin continuous strip member; and said strip member having an abutment for locking engagement with said abutments in said narrow channel to position the uppermost end of said upper portion against the other peripheral surface of said second pane to exert a pressure thereon as said lower portion flexes and contacts said window frame.

2. A window structure as set forth in claim 1 wherein said retainer and said trim member are substantially thinner in cross section than the thickness of said panes.

3. A window structure as set forth in claim 2 wherein said lower portion of said trim member is approximately one-half the thickness of said upper portion.

4. A double glazed window structure consisting of a rectangular frame with a first pane securely mounted therein, said first pane having a periphery, a sealant tape adhesively fastened to said entire periphery of said first pane, a rigid flat retainer support member securely fastened to said frame, said rigid retainer support member extends around said entire periphery of said first pane, said retainer having one end abutting said first pane, said retainer having the other end parallel to said one end and defining a linear edge, said retainer support member having a flange extending parallel to the body of said retainer and in a direction away from said first pane, said retainer support member having a midpoint on said body that is substantially midway between said one end and said other end, said flange is connected to and integral with said midpoint of said retainer, said flange having an edge parallel to said linear edge and adjacent thereto, a second pane in sealing engagement with said flange and said tape to define a dead air space between said panes, said flange cooperative with said retainer to define a channel therebetween, said flange having a series of abutments lying inwardly to said channel, a flat longitudinally extending trim member having an outwardly extending strip, said strip having abutment means for latching with said one of said abutments on said flange to secure said trim member into position such that its one outer end abuts said frame and the other outer end abuts said second pane to maintain pressure thereon to maintain said second pane in engagement with said sealant tape.

5. A compression decorative retainer for maintaining a secondary window pane against a sealing strip to create with an existing primary window pane and window frame a dead air space between the primary window pane and the secondary window pane, the compression retainer having a flat longitudinally extending rigid support strip secured to the window frame, said retainer support including a flat face for contacting said window frame, a rigid longitudinally extending flange integrally formed with said support strip, said flange extends parallel to said strip but spaced therefrom to define a narrow channel therebetween, said flange having a plurality of abutments projecting into said channel, said flange contacting and supporting said secondary pane in abutting contact with said sealant strip, a flat trim member having one end portion resting on said window frame and the other end portion contacting said secondary plane, said trim member having a latch projecting into said channel for latching with one of said abutments, and said latch being selectively engageable with said abutments for adjusting the compression of said other end portion of said trim member to adjust the compression of said secondary pane on said sealing strip along the full continuous length thereof.

6. A system for creating a dead air space between an existing window with a periphery that is fully seated within a window frame and a piece of glazing to be mounted adjacent thereto, said system comprising a piece of glazing with an exterior surface an interior surface and a periphery, said exterior surface being closer to said existing window than said interior surface, a deformable sealant tape adhered to the periphery of said existing window for contact with said exterior surface of said glazing, said sealant means operative to space said piece of glazing away from the existing window and to seal the space therebetween when said piece of glazing is properly compressed, retainer means secured to said window frame and being operative to compress said piece of glazing against said sealant means thereby forming a dead air space, said retainer means having a continuously longitudinally extending linear abutment means running the full length of the periphery of said glazing, said retainer means having a flat continuous rail member secured along its length to said window frame running the full length of the periphery of said glazing, a trim member with a continuously longitudinally extending latch means running the full length of the periphery of said glazing but spaced away from and movable with respect to said retainer means to latch onto said abutment means for compressing said piece of glazing against said sealing strip, and said latch means being selectively operable with said abutment means for adjusting the space between said retainer means and said trim member by tensioning said trim member to compress said glazing while seating a portion of said trim member firmly against said window frame to compress said sealant tape mounted between said piece of glazing and said window, and said trim member maintaining a constant continuous pressure along the full peripheral length of contact with said glazing.

* * * * *